United States Patent [19]

Shear

[11] Patent Number: 4,466,217

[45] Date of Patent: Aug. 21, 1984

[54] TECHNIQUE FOR AIDING IN INSERTING A PLANT POT INTO AND REMOVING IT FROM A PLANT HANGER

[76] Inventor: Stephen C. Shear, 1726 Wright Ave., Sunnyvale, Calif. 94087

[21] Appl. No.: 426,942

[22] Filed: Sep. 29, 1982

[51] Int. Cl.[3] ..... A01G 13/00

[52] U.S. Cl. ..... 47/58; 47/67; 47/1 R; 289/15

[58] Field of Search ..... 47/67, 39, 58; 289/13, 289/15, 16.5, 14, 17

[56] References Cited

U.S. PATENT DOCUMENTS 941,448 11/1909 Haglund ..... 47/67 X 4,057,210 11/1977 Welman ..... 47/67 X 4,349,172 9/1982 Banks ..... 47/67 X

*Primary Examiner*—Robert A. Hafer

*Assistant Examiner*—Danton DeMille

*Attorney, Agent, or Firm*—Flehr, Hohbach, Test, Albritton & Herbert

[57] ABSTRACT

A technique for aiding in placing a planter pot into and removing it from a plant hanger is disclosed herein. The plant hanger is of the type having a plurality of cords extending from a common top to a bottom base section and the technique disclosed serves to spread these cords apart to allow passage of the plant pot into and out of the hanger.

6 Claims, 7 Drawing Figures

TECHNIQUE FOR AIDING IN INSERTING A PLANT POT INTO AND REMOVING IT FROM A PLANT HANGER

The present invention relates generally to plant hangers and more particularly to a method and apparatus for aiding an individual in inserting a plant pot (including a plant) into and removing it from the hanger.

A typical plant hanger of the general type to which the present invention is directed is one which includes a plurality of cords, typically four, extending from a common top section to a bottom base section. The hanger is held at its top section to a hook which is typically mounted to the ceiling or a wall support and the base section supports the plant pot.

In the plant supporting position just described the cords comprising part of the overall hanger are relatively close to one another, especially when there are four or more cords. This makes it difficult to remove the potted plant when necessary and even more difficult to place it back into the hanger. This is especially true when the plant being handled is large or full, that is, including many shoots and leaves. It is difficult for a single individual to hold the plant while at the same time spreading the cords to insert it into or remove it from the hanger without damaging some of the shoots or leaves. Hanging and/or removing some plants often requires two people.

As will be seen hereinafter, the present invention provides a relatively easy way to remove potted plants from and insert them into a hanger of the type described without damaging the plant and without the need for more than one person. As will also be seen, this is accomplished in an uncomplicated and economical way.

In view of the foregoing, one object of the present invention is to provide a relatively simple and uncomplicated method of placing a potted plant into and removing it from a plant hanger.

Another object of the present invention is to carry out the method just recited without damaging the plant.

Still another object of the present invention is to provide a method which requires only one person and which can be carried out while the hanger remains in its supported position.

A further object of the present invention is to provide a particular apparatus to be used in carrying out the method just recited.

Still a further object of the present invention is to provide an apparatus which can be used with plant hangers differing in size as well as ones having differing numbers of cords.

As stated above, the plant hanger itself includes a plurality of cords extending from a common top section to a bottom base section. The potted plant (including of course the pot) is placed into or removed from this hanger by first mechanically maintaining the cords in positions which are displaced from their normal pot hanging positions. This provides a plurality of spaces between certain ones of the cords and each of these spaces is wider than the space between any adjacent cords when the latter are in their normal pot hanging positions. Once these spaces are provided, the plant can be easily placed into or removed from the hanger by passing it through the space between two cords. As will be seen hereinafter, in accordance with a preferred embodiment, when placing a plant into a hanger the cords are mechanically displaced by two pairs of interconnected elongated members (slats). On the other hand, when removing the plant from the hanger only one pair of these elongated members is required.

Figure 1:
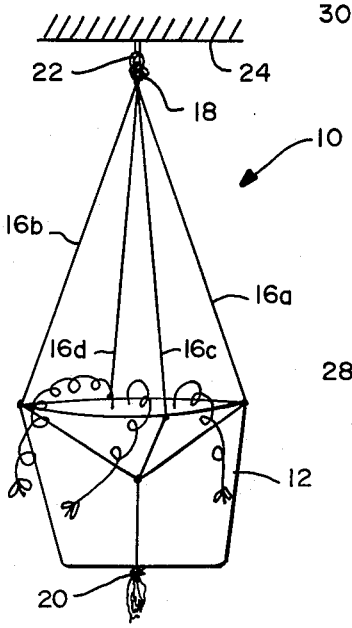
FIG. 1 is a side elevational view of a potted plant and plant hanger in a normal pot hanging position.

Turning now to the drawings wherein like components are designated by like reference numerals, attention is first directed to FIG. 1. This figure shows a conventional plant hanger 10 supporting a plant pot 12 and associated potted plant 14. As illustrated in FIG. 1, hanger 10 includes four cords **16*a*, 16*b*, 16*c* and 16*d* which extend from a common top 18 to a bottom base section 20. Top 18 is connected to a hook or other such suitable fastening means 22 held to the ceiling or other such fixed support 24**.

With hanger 10 in its normal pot hanging position as seen in FIG. 1, it should be apparent that the space between any two cords is relatively small near the bottom and becomes even smaller toward the top of the hanger. It should also be apparent that the various shoots or stems and leaves forming part of plant 14 pass through these various spaces and either drape down below the plant pot as shown or with some plants extend up and beyond the pot and hanger. In either case, in order to move the potted plant it must be passed in its entirety through a single one of these spaces. This means that the plant foliage must first pass through the other spaces. This is also true when placing the potted plant back into the hanger. More specifically, it must be initially passed through a single space and thereafter the various shoots and stems including any leaves or flowers thereon must be divided between all of the spaces. As stated previously, this is very difficult to do for one person without damaging the plant especially when the plant is large. However, as will be seen hereinafter, the present invention provides a method and apparatus for accomplishing both steps in an uncomplicated and economical manner without requiring more than one person and without damaging the plant.

Figure 2:
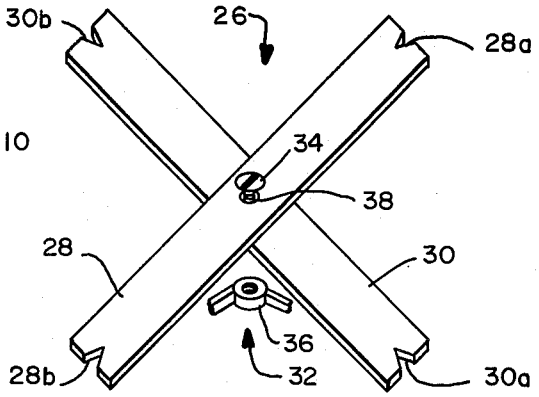
FIG. 2 is a perspective view of an apparatus which is designed in accordance with the present invention and which is provided for aiding in placing the plant shown in FIG. 1 into and removing it from its plant hanger.
Figure 3:
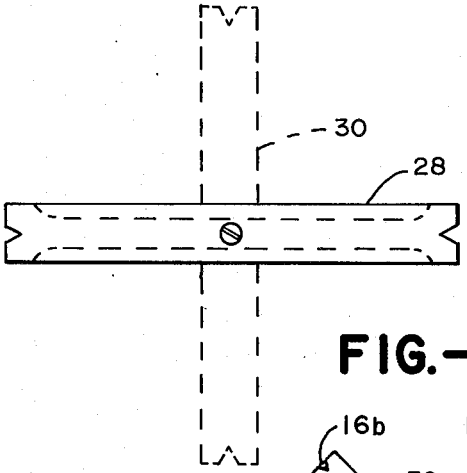
FIG. 3 is a top plan view of the apparatus illustrated in FIG. 2.

Turning specially to FIGS. 2 and 3, an apparatus designed in accordance with the present invention and generally designated by the reference numeral 26 is shown. This apparatus includes a pair of elongated members 28 and 30, each of which includes a V-shaped slit or notch **28*a*, 28*b* and 30*a*, 30*b***, respectively, located at opposite ends thereof. As seen both in FIGS. 2 and 3, each V-shaped notch tapers inward to a point. Each elongated member is preferably an integral unit constructed of wood or plastic.

As seen best in FIG. 1, apparatus 26 also includes an arrangement 32 for interconnecting the two elongated members at their centers and for allowing these members to slidably rotate relative to one another between the perpendicular position illustrated in FIG. 2 and the parallel position illustrated in FIG. 3 where the bottom member 30 is not seen in solid lines since it is directly under and coincides with top member 28, although it is shown by dotted lines in its perpendicular position. Arrangement 32 may be of any conventional type but is preferably comprised of a bolt 34, a threaded wing nut 36 and a cooperating lock washer 38. A spring (not shown) may be provided in the appropriate location in this arrangement to bias the two elongated members against one another so that they will remain in the position selected, particularly the perpendicular position which, as will be seen, is important.

Figure 4:
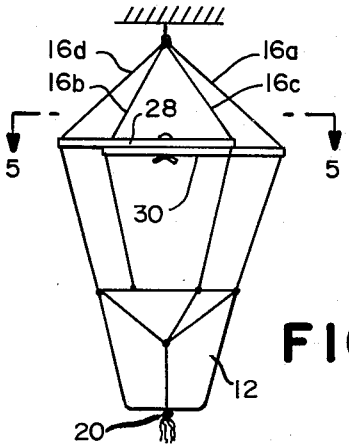
FIG. 4 is a side elevational view illustrating how the apparatus of the FIGS. 2 and 3 cooperates with the hanger of FIG. 1 for aiding in the removal of the plant supported thereby.
Figure 5:
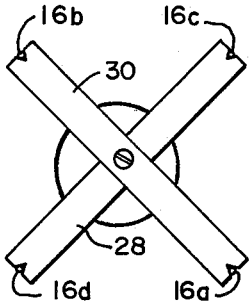
FIG. 5 is a sectional view taken generally along line 5—5 of FIG. 4.

Having described apparatus 26, attention is now directed to the way in which it is used to aid in removing pot 12 and its plant 14 from hanger 10. This is best seen in FIGS. 4 and 5 where for purposes of clarity the plant itself has not been shown. As seen in these figures, the two elongated members 28 and 30 are maintained in their perpendicular position within the hanger and above the plant. As seen best in FIG. 5, the two cords **16*a* and 16*b* are respectively disposed within the two slits or notches at the opposites of member 30, specially notches 30*a* and 30*b* while the two cords 16*c* and 16*d* are disposed within the two notches 28*a* and 28*b* in the ends of elongated member 28**. Each cord is forced as far into its V-shaped notch as possible so as to be wedged in place. This wedging effect in conjunction with the tendency for the cords to want to move back to their normalplant hanging positions causing the apparatus to remain in place.

With apparatus 26 positioned in the manner described, it should be apparent that the two elongated members mechanically maintain the cords in positions which are displaced from their normal pot hanging positions so as to provide a plurality of wider spaces between certain ones of the cords, specifically between each pair of adjacent cords in the embodiment illustrated. In a preferred embodiment, apparatus 26 is positioned as close as possible to top 18 or as far as possible from the plant so that the widened spaces are vertically as large as possible. Once these spaces are provided, the next step in removing pot 12 and its plant is to select one of the spaces which will be used to pass the pot through and plant. In most cases the space selected should be the one which already includes most of the plant stems and shoots. This is because the next step in this removal procedure will be to move the various shoots and stems located in the non-selected spaces to the selected space, particularly when these shoots and stems are relatively long. Once this has been done, the pot itself can be lifted up and out through the selected space. If the pot and plant are to be returned to the hanger, apparatus 26 may remain in place.

It should be apparent from the foregoing that apparatus 26 provides a relatively easy and uncomplicated way of removing pot 12 and its associated plant from hanger 10. As will be seen below, apparatus 26 is also used in placing the pot and plant back into the hanger. However, a second apparatus 26 is also used (see FIG. 6) as will be discussed below.

Figure 6:
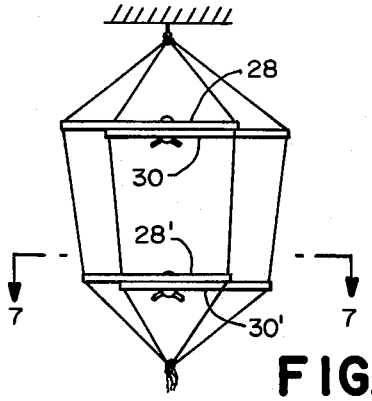
FIG. 6 is a side elevational view illustrating how the apparatus of FIGS. 2 and 3 and a second similar or identical apparatus cooperate with the plant hanger of FIG. 1 to aid in placing a plant therein.
Figure 7:
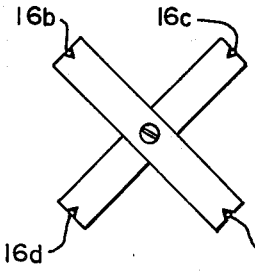
FIG. 7 is a sectional view taken generally along line 7—7 in FIG. 6.

Turning specifically to FIG. 6 in conjuction with the FIG. 7, apparatus 26 is shown in the same position in cord 10 as described with respect to FIGS. 4 and 5. In addition, a second apparatus 26' which may be identical to apparatus 26 or which may be different to the extent that it may include either larger or smaller elongated members is supported within the hanger in the same manner, as best seen in FIG. 7. However, apparatus 26' is located below and spaced from apparatus 26, preferably as close to base section 20 as possible. As a result of this, the cords are mechanically maintained in displaced positions from their normal pot hanging positions, both near the top of the hanger and near the bottom so as to provide somewhat rectangular spaces between adjacent cords. In order to placethe pot and plant into the hanger, they are first passed through one of these spaces between apparatus 26 and apparatus 26' and held in this position while the various shoots and stems are distributed among all of the spaces. Once this has been done, the bottom apparatus 26' is removed. This is accomplished by first disengaging the cords from their respective notches and thereafter moving the two elongated members 28' and 30' to their parallel position so that they can be easily passed out of the hanger. Where the plant itself is not too large it may be possible to remove apparatus 26' before redistributing the stems and shoots. In either case, once apparatus 26' is removed, the pot and plant are supported on bottom section 20 and top apparatus 26 can then be removed in the same way as the bottom apparatus.

It should be apparent that the procedure just described is uncomplicated and may be carried out relatively rapidly. While the elongated members making up the top apparatus may be longer than the elongated members making up the bottom apparatus, in the preferred embodiment they are of the same length. In an actual working embodiment, each of these elongated members is approximately 14 inches long from tip to tip and each shaped notch is approximately 1 inch long and 1 inch wide (maximum). While these notches are shown relatively smooth they may be serrated to more tightly hold the cords. Moreover, while each slat is shown generally rectangular, their edges may be rounded and most of their lengthwise section may be thinner than their ends as indicated by dotted lines in FIG. 3. This allows the elongated members to be as thin as possible so as to minimize their weight while maintaining ends which are sufficiently large to properly define the V-shaped notches.

Both apparatus 26 and 26' were shown associated with a hanger including four cords. The hanger could, however, be one which includes more than four cords or it could be one which includes only three cords. In either case, each apparatus 26 and 26' could be utilized. For example, if the hanger includes only three cords, one end of one of the elongated members of each apparatus would not be used. On the other hand, where the hanger includes more than four cords, for example six or eight cords, the given end of each elongated member may include more than one cord. In this case, plant foliage would not be provided between those cords until the apparatus is removed. It is to be understood, however, the present invention is not limited to the two member apparatus. Either apparatus described could include more than two elongated members, for example three members, and function in accordance with the principles described herein. However, it would be more difficult to remove such an apparatus.

What is claimed is:

1. A method of removing a hanging plant pot from a support hanger having a plurality of cords extending from a common top to a bottom base section, said method comprising:

(a) mechanically maintaining said cords in positions which are displaced from their normal hanging positions when the pot is supported thereby so as to provide a plurality of spaces between certain ones of said cords, each of said spaces being wider than the space between its adjacent cords when the latter are in said normal pot hanging positions; and (b) providing a mechanical apparatus including a pair of first and second elongated members interconnected in a pivotal manner at their centers such that said members are positionable prependicular to one another and parallel to one another, said mechanical apparatus with its elongated members maintained perpendicular to one another being used to mechanically maintain said cords in positions which are displaced from their normal hanging positions by engaging opposite ends of one of said members against predetermined ones of said cords and the opposite ends of the other member against other predetermined cords;

(c) while said cords are maintained in said displaced positions, manually moving said planted pot out of said hanger through one of the said spaces.

2. A method of placing a hanging plant pot into a support hanger having a plurality of cords extending from a common top to a bottom base section, said method comprising:

(a) mechanically maintaining said cord in positions which are displaced from their normal pot hanging positions when a pot is supported thereby so as to provide a plurality of spaces between certain ones of said cords, each of said spaces being wider than the space between its adjacent cords when the latter are in said normal pot hanging positions;

(b) providing two mechanical devices, each of which includes a pair of first and second elongated members pivotally connected to one another at their centers so as to be movable between parallel and perpendicular positions, said devices being respectively utilized with their elongated members in perpendicular positions for mechanically maintaining said cords in said displaced positions near the top of said hanger and at points near the bottom base of the hanger;

(c) passing a planter pot containing a plant through one of said spaces and into said hanger; and (d) thereafter freeing said cords from their mechanically maintained positions so as to move to their normal pot hanging positions whereby to support said planter pot.

3. A method according to claim 2 wherein said cords are initially mechanically maintained in said displaced positions at points near the common top of said hanger and at points near the bottom base of said hanger, wherein said pot is placed into said hanger through one of said spaces between said top and bottom points and wherein said cords are first freed at said bottom points and thereafter at said top points.

4. An apparatus for aiding in placing a planter pot into and removing said pot from a planter pot support hanger having a plurality of cords extending from a common top to a bottom base section, said apparatus comprising:

(a) a pair of first and second elongated members;

(b) means for interconnecting said first and second members at their centers for movement such that said members can be maintained perpendicular to one another and parallel to one another; and (c) means located at each end of each of said members for removably engaging at least one of said hanger cords in an unconnected fashion whereby to maintain said cords in positions which are displaced from their normal pot hanging positions when the elongated members are perpendicular to one another so as to provide a plurality of wider spaces between certain ones of said cords for placing said pot into said hanger or for removing said pot therefrom.

5. An apparatus according to claim 4 wherein each of said removably engaging means comprises a slit extending to the associated end of an associated one of said members.

6. An apparatus according to claim 5 including a second pair of said first and second members, interconnected together in the same way as said first pair and including identical slits.

* * * * *